United States Patent [19]

Schroeder

[11] 4,344,584

[45] Aug. 17, 1982

[54] APPARATUS FOR WINDING WEBS

[75] Inventor: Roger A. Schroeder, Green Bay, Wis.

[73] Assignee: American Can Company, Greenwich, Conn.

[21] Appl. No.: 240,110

[22] Filed: Mar. 4, 1981

[51] Int. Cl.[3] ..... B65H 19/06; B65H 19/26

[52] U.S. Cl. ..... 242/56 A; 242/64

[58] Field of Search ..... 242/56A, 64

[56] References Cited

U.S. PATENT DOCUMENTS

| | | | |
|---|---|---|---|
| Re. 28,353 | 3/1975 | Nystrand et al. | 242/56 A |
| 2,716,437 | 8/1955 | Wikle | 242/64 X |
| 2,769,600 | 11/1956 | Kwitek et al. | 242/64 X |
| 3,207,452 | 9/1965 | Haskin, Jr. et al. | 242/64 |
| 3,297,271 | 1/1967 | Haskin, Jr. | 242/64 X |
| 3,552,670 | 1/1968 | Herman | 242/56 A |
| 3,783,750 | 1/1974 | Heimeijer | 242/56 A X |

*Primary Examiner*—Harvey C. Hornsby
*Assistant Examiner*—Frankie L. Stinson
*Attorney, Agent, or Firm*—Robert P. Auber; George P. Ziehmer; Harry W. Hargis, III

[57] ABSTRACT

Apparatus for winding webs from a large-diameter roll onto cores to form smaller diameter rolls wherein the cores are supported on mandrels mounted at one end on a turret that is indexed between a core loading station, operational stations including at least a web winding station, and a wound-web unloading station. A pair of axially spaced star wheels keyed to a freely rotatable shaft having its axis parallel to the axes of the mandrels sequentially are engaged by, are rotated by, and are disengaged from a mandrel as it is moved between the core loading and winding stations to ensure alignment of the free end of the mandrel for supporting engagement with a provided latching cup operative to engage and steady the mandrel in the operational stations.

11 Claims, 6 Drawing Figures

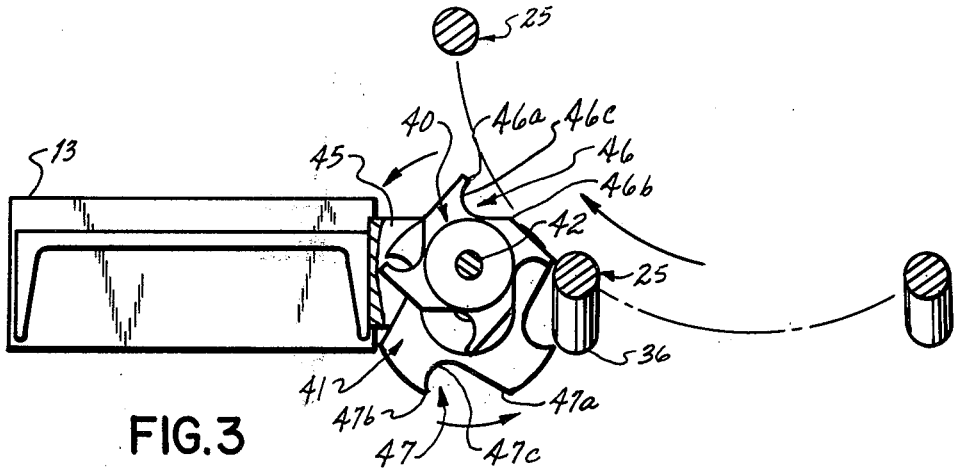
FIG.3
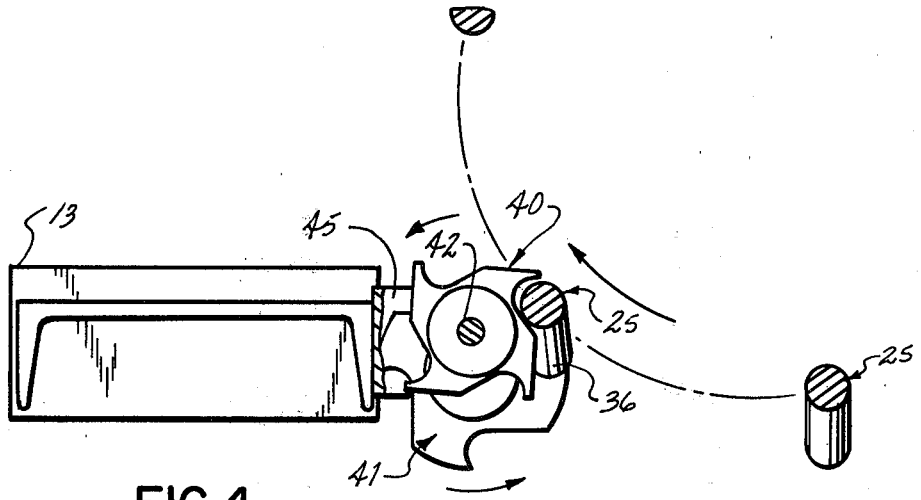
FIG.4
FIG.5
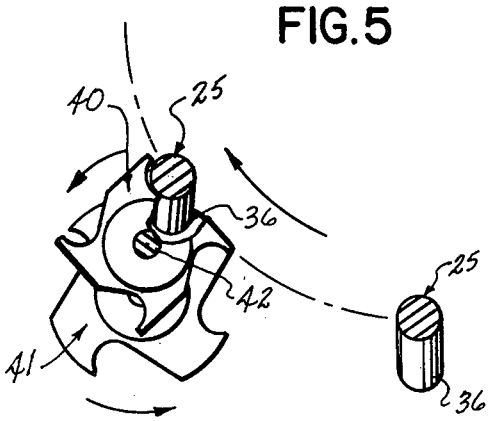
FIG.6
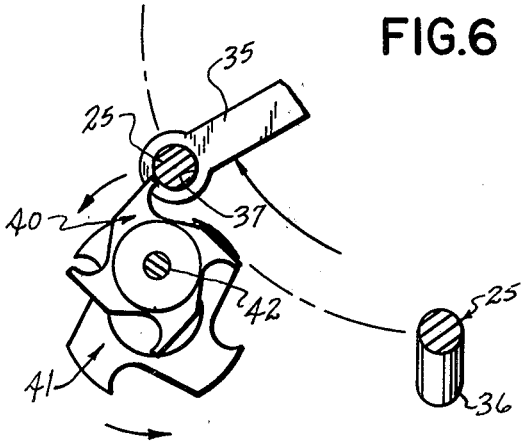

APPARATUS FOR WINDING WEBS

BACKGROUND OF THE INVENTION

This invention relates to apparatus for winding webs, and more particularly to improvements in apparatus for winding elongate rolls of webs such as paper to be cut into rolls of lesser length.

In the manufacture of rolls of towels, tissue, and the like, paper of a suitable basis weight and caliper is formed as a relatively wide web and is wound either into a larger-sized parent roll for subsequent rewinding into a lesser sized roll, or it is wound into rolls of lesser size directly from the forming apparatus. The lesser sized rolls are termed "logs", and are cut into rolls of lesser length for use by the consumer.

Apparatus for winding webs generally comprises a series of mandrels for carrying cores, each mounted at one end on a turret rotatable about a horizontal axis. Each mandrel is indexed sequentially, in an orbital travel path, between a core loading station, operational stations such as adhesive applicator, winding, and tail sealing stations, and a log unloading station. The free ends of the mandrels are unsupported at the core loading and the log unloading stations. The mandrels are engaged and supported, however, at the operational stations by a suitable latching or support cup. Due to the one-ended or cantilever support of the mandrels, which are relatively long, they tend to flex, making it difficult to align them for engagement by the latching cups at the operational station. For convenience of description of the present invention, the winding station, the adhesive applicator station, and the tail sealing station also will be referred to generally as the operational stations. Apparatus of the kind thus far described is well known, for example in U.S. Pat. No. 2,769,600, the disclosure of which is hereby incorporated by reference.

It is an objective of the present invention to provide simple and effective means for overcoming the hereinabove described alignment difficulties such as are encountered in a web winding apparatus.

It is a further objective of the invention to provide improved means that is readily included in an existing web winding apparatus, for overcoming the hereinabove described alignment difficulties.

SUMMARY OF THE INVENTION

In achievement of the forgoing as well as other objectives, the invention contemplates an improvement in apparatus for winding webs into rolls, of the type in which a plurality of rotatable web winding mandrels are supported at one end on a unidirectionally rotatable turret operative to index the mandrels sequentially, in an orbital travel path between at least core loading, operational, and wound-roll unloading stations, wherein the improvement comprises means cooperative with each said mandrel as it is moved from the core loading toward the operational station to support and to position the free end of the mandrel for engagement by provided latching means in its operational stations.

The manner in which objectives and advantages of the invention may best be achieved will be more fully understood from a consideration of the following description, taken in light of the accompanying drawing.

BRIEF DESCRIPTION OF THE DRAWINGS

FIGS. 3 to 6 are enlarged elevational showings, partly in section, of a portion of the apparatus seen in FIG. 2, and illustrating operation of the novel portions of the apparatus.

DESCRIPTION OF THE PREFERRED EMBODIMENT

Figure 1:
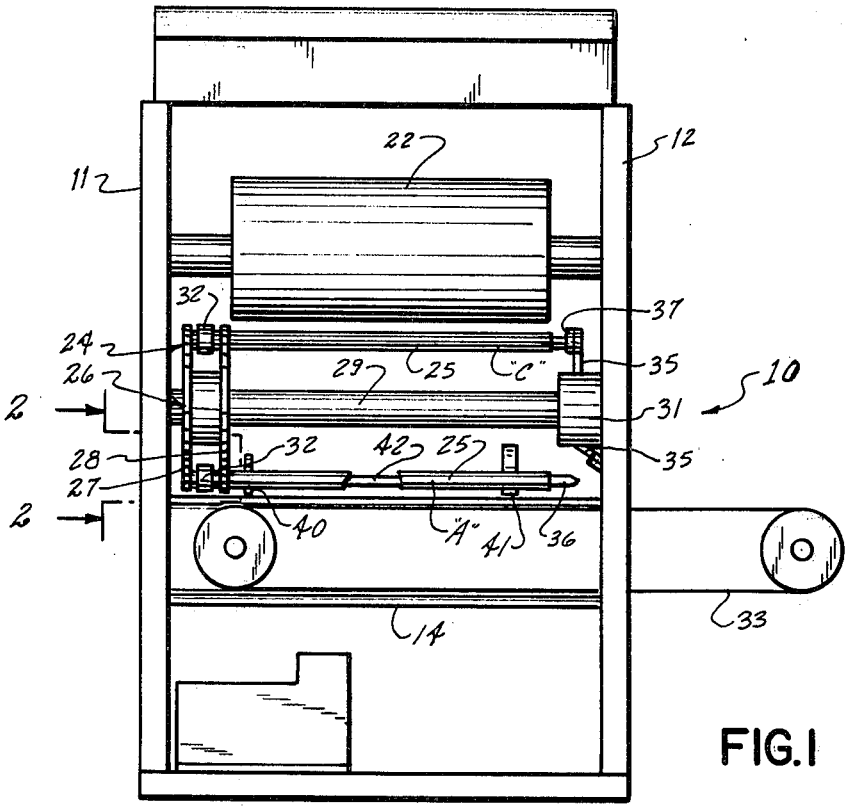
FIG. 1 is a partially fragmented elevational showing of web winding apparatus embodying the invention.
Figure 2:
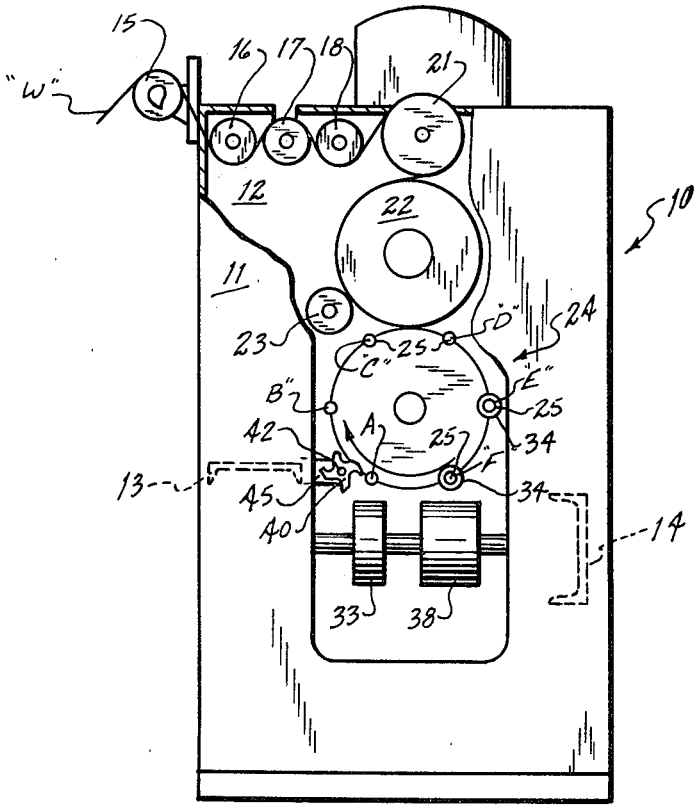
FIG. 2 is a partially sectioned, fragmented showing taken generally along the line 2—2 in FIG. 1, and looking in the direction of arrows applied thereto.

With more detailed reference to the drawings, there is seen in FIGS. 1 and 2 an apparatus 10 for winding a web W from a parent roll (not shown), or directly from a web forming apparatus (not shown), into smaller rolls known as "logs". Apparatus 10 comprises a pair of upright frames 11 and 12 interconnected by at least a pair of channel-shaped frame spacers 13 and 14. Web W, which may be any one of known paper products suitable for towels or tissues, is fed over an idler roll 15 extending between frames 11 and 12, and suitably mounted on the frames for free rotation. Web W then is fed under, over, and under suitably driven feed rolls 16, 17, and 18, respectively, that extend between frames 11 and 12, and are parallel to idler roll 15. From the feed rolls, web W is drawn over a driven perforator roll 21, of known construction and mounted on frames 11 and 12, thence over a bedroll 22 disposed below perforator roll 21 and parallel thereto. A chopper roll 23, also of known construction, is disposed parallel to and to a side of bed roll 22 over which web W extends, and is adapted to cooperate with the bed roll to cut web W.

At this stage of the disclosure it is in order to describe the mandrel assembly designated generally by the numeral 24, and its relationship to the portions of the apparatus thus far described, as well as its relationship to additional portions of the apparatus to be described hereinbelow.

Mandrel assembly 24 comprises a plurality of individual, generally cylindrical mandrels 25, for example six in number, parallel to one another and to rotational axes of the rolls thus far described. Mandrels 25 are rotationally supported on a turret 26 rotatable incrementally by a suitable Geneva drive (not shown) on frame 11, which may be of the type disclosed in the referenced U.S. Pat. No. 2,769,600. The turret 26 generally comprises a pair of spaced discs 27, 28 from which a central shaft 29 extends and is rotatably supported at its other end in suitable bearing structure 31 on frame 12. Each mandrel 25 includes a pulley 32 keyed thereto, the function of which will be more fully explained hereinbelow. Turret 26 is incrementally rotatable in a clockwise or right-hand direction, as viewed in FIG. 2, in provision of the illustrated dwell positions of mandrel 25.

Considering the dwell positions in more detail, lower left hand position A is a core loading station, in which hollow cores are loaded by a conveyor belt 33 onto free ends of mandrels 25.

The next dwell position B of a mandrel 25 is an adhesive applicator station, at which an adhesive such as glue is applied along the length of a core by suitable means (not shown), for example applicator means of the type shown in the referenced U.S. Pat. No. 2,769,600.

The next dwell position C is a blank station, and in moving from position C to dwell position D which is the winding station, the severed tail of the web on bedroll 22 is transferred to the adhesive-bearing core on mandrel 25. As the core-bearing mandrel 25 is positioned in station D, pulley 25 is engaged by a suitable friction drive of known construction, which may be, for example of the belt-drive type seen also in the referenced U.S. Pat. No. 2,769,600.

Upon winding of the roll or log 34, the turret 26 is indexed to move the log-bearing mandrel 25 to the tail-sealing station at position E. Tail sealing may be achieved by any one of a number of known means, an example of one such means being adaptable to the present apparatus and disclosed and claimed in the copending application of Thomas B. Howard et al, Ser. No. 119,162, filed Feb. 6, 1980, and assigned to the assignee of the present invention.

Turret 26 then indexes the sealed roll 34 to the unloading station at dwell position F, where it is engaged by suitable belt-driven unloading apparatus 38 of known construction, for example of the type disclosed in the referenced U.S. Pat. No. 2,769,600.

Further to the web winding apparatus thus far described, and for still further appreciation of advantages achieved by the present invention, the rolls or logs 34 are in the order of 95 inches in length, so that the mandrels 25 are of comparable length. Mandrels 25 are, however, relatively small in diameter, and since they are supported by turret 26 at one end only, in cantilever fashion, there is considerable tendency for them to sag. To provide for support or latching of the mandrels 25 in dwell positions B, C, D, and E, which comprise the several operational stations, and as seen only in FIG. 1, there are provided radially extending, cam actuated support or latching arms 35, each in correspondence with a mandrel end 36. Each arm 35 includes a rotational cone-shaped pocket 37 (FIG. 6 only) that engages and receives a cone shaped mandrel end 36 as the arm 35 is cammed toward the mandrel. In positions A and F, the arms 35 and pockets 37 are cammed away from mandrel ends 36 to accommodate core loading and log or roll unloading. Mandrel support arms 35, including cone-shaped pockets, and cam means for operating the arms are disclosed also in the referenced U.S. Pat. No. 2,769,600, which teaches additionally provision of U-shaped members on each arm to guide the mandrel ends into the cone shaped pockets. Sagging of the mandrel ends does not always follow a uniform pattern, however, and the U-shaped elements have been found not always to engage and guide the cone-shaped mandrel ends.

In especial accordance with my invention, I provide an improved means for accurately and automatically positioning a mandrel 25 for positive engagement of its cone-shaped free end 36 by a cone-shaped support pocket 37, as the mandrel is indexed from the core loading station at position A to the glue applicator station at position B, i.e., from the loading station to the first operational station. The arm 35 and pocket 37 then remain in such supporting engagement throughout the remaining operational stations, at positions C, D, and E as hereinabove described.

My improved positioning means comprises a pair of star wheels 40 and 41 keyed to a shaft 42 extending substantially parallel to the unsupported, sagging mandrel in the loading station at position A. Shaft 42 further is disposed in the region of the lower left sector of the mandrel travel path, between mandrel positions A and B, and is rotationally supported at its ends in suitable bearings of known construction, and at its center on bearing 45, all bearings being supported on frame spacer 13 by suitable bracket means of known construction.

Considering the star wheel and shaft assembly in more detail, and as is best seen in FIG. 2, star wheel 40 is positioned toward or in correspondence with the turret-supported ends of mandrels 25, and star wheel 41 is positioned toward the free ends 36 of mandrels 25. As is seen in FIG. 3, star wheel 40 has four generaly radially outwardly facing pockets 46. In FIG. 3, there is illustrated the dwell position of turret 26, wherein a leading edge portion **46*a* of each pocket 46 projects into the orbital travel path of the mandrels 25, whereas a trailing edge portion 46*b* of the same pocket is outside the oribital path. A mandrel-receiving, intervening portion 46*c*** of the pocket is a generally circular segment.

Further to the showing of FIG. 3, star wheel 41 has four generally radially outwardly facing pockets 47 defined by a somewhat straight leading edge portion **47*a* projecting into the orbital travel path of the sagging free ends 36 of mandrels 25, a trailing edge portion 47*b* also projectable into the orbital travel path of the free ends of the mandrels and a mandrel-receiving, intervening generally circular segment 46*c*. Of the star wheels, pockets 46 are a lesser radial distance from shaft 42 than the radial distance of pockets 47** from the shaft.

Further to construction and arrangement of the star wheels 40 and 41, each of the respective circular segments **46*c* and 47*c* of the pockets is essentially of the same radius as a mandrel 25, and are presented generally toward one another as respects their paths of rotational movements with the rotating star wheels to facilitate their engagements and disengagements as respects the mandrels. Thus, segment or portion 46*c* is presented in a direction opposite to the direction of travel of mandrel 25, and segment or portion 47*c* is presented in the direction opposite to direction of rotation of the star wheels. The parallel relationship between the star wheel shaft 42 and a sagging mandrel 25 in dwell position A is seen to advantage in FIG. 3, wherein the centers of rotation of the star wheels 40 and 41** are offset vertically.

Construction and arrangement of the star wheels 40 and 41, in relationship to mandrels 25, is such that, and assuming the starting position shown in FIG. 2, and in more detail in FIG. 3, as turret 26 moves a mandrel 25 from its dwell position A toward its dwell position B, the mounted end of a mandrel 25 engages the leading edge **46*a* of a pocket 46 of star wheel 40. Continued orbital movement of mandrel 25 causes star wheel 40 to rotate to the position seen in FIG. 4, also rotating shaft 42 and star wheel 41 on its opposite end. This accompanying rotation of star wheel 41 causes its pocket 47 to engage the sagging free end 36 of mandrel 25. Continued movement of mandrel 25 to the position shown in FIG. 5 continues the rotation of star wheels 40 and 41, each to a position in which its respective circular pocket portions 46*c* and 47*c* each receive the mandrel, and wheel 41, due to the greater radial distance of its pocket 47 from shaft 42 relative to that of pocket 46, elevates and substantially aligns the cone shaped free end 36 of mandrel 25 both with its supported end and with the cone shaped pocket 37 of cam actuated arm 35, (FIG. 1) as the arm is cammed into position for engaging the pocket 37 with the free end of the mandrel. In provision of substantial alignment of end 36 with pocket 37, the end 36 need not be at the precise level of the mounted end of the mandrel. The tip of cone-shaped end 36 need only be within the larger diameter portion of cone shaped pocket 37**.

The turret 26 continues its rotation, moving the now-fully-supported mandrel toward its next dwell position as seen in FIG. 6. Upon such continued rotation to a dwell position, the supported mandrel 25 is disengaged from the star wheels 40, 41, which then are in the position shown in FIGS. 2 and 3, ready for the next mandrel. It will be appreciated that the described motions are rapid, and to ensure proper positioning of the star wheels 40, 41 at a dwell position, suitable shaft restraining means is provided, such as, for example, a friction brake device of known construction in combination with shaft 42 and its support.

From the foregoing description, it will be appreciated that the star wheel assembly operates automatically to position the somewhat flexible mandrel 25 for positive engagement by its corresponding support arm 35. It will be further appreciated that modifications may be made in the disclosed apparatus without departing from the scope of the appended claims.

I claim:

1. In apparatus for winding webs into rolls, wherein a web is fed onto a core carried by one of a plurality of a mandrels, each supported at one end on an incrementally rotatable turret operative to move the mandrels in an orbital travel path between at least core loading, operational, and wound-roll unloading stations, said mandrel having non-supported free ends in said loading and said unloading stations, and support means movable into supporting engagement with said free ends as said mandrels are indexed from said loading station toward said operational stations, and wherein said non-supported mandrels are succeptible of sagging relative to the supported ends, the improvement comprising:

a rotatable shaft having its axis substantially parallel to the axes of said mandrels in said core loading station, said shaft being disposed in spaced relation to the orbital travel path of said mandrels as they are indexed between said core loading and said operational stations; and a pair of star wheels spaced axially along said shaft in correspondence with the supported ends and the free ends of said mandrels, each said star wheel including a plurality of equally angularly spaced, generally radially outwardly presented pockets, said pockets in one rotational position of said shaft being positioned and arranged to receive a mandrel as it is indexed between a core loading station and on operational station, said shaft being rotatable while said mandrel is in said pockets until such position of said mandrel is reached that the sagging free end thereof is elevated by its corresponding star wheel into a position substantially aligned with and to be engaged by provided latching means for holding it in said operational stations, said star wheels being positioned and arranged to release said engaged mandrel and to receive in a successive set of pockets the next successive mandrel as it is moved from the core loading station.

2. Apparatus of claim 1, wherein the one of said star wheels disposed in correspondence with said one end of said mandrels is rotatable by the mandrel received in said pockets, upon the recited indexing of said mandrel.

3. Apparatus of claim 2, wherein said mandrels are generally cylindrical, and each said pocket includes a generally circular segment corresponding substantially to the curvature of the cylindrical mandrel, said circular segment of said one of said star wheels being presented opposite to the direction of travel of said mandrel upon receiving the latter, and said circular segment in the star wheel disposed in correspondence with said free end of said mandrel being presented in a direction opposite to the direction of rotation of said star wheels.

4. Apparatus of claim 1, 2, or 3, wherein said free ends of said mandrels are generally cone-shaped and said support means comprise means defining cone-shaped pockets for receiving said free ends.

5. Apparatus of claim 1, 2, or 3, wherein said pockets of said star wheel disposed to engage said free end of said mandrel are of greater radial distance from said shaft then the distance of said pockets of the other star wheel from said shaft.

6. Apparatus of claim 4, wherein said pockets of said star wheel disposed to engage said free end of said mandrel are of greater radial distance from said shaft than the distance of said pockets of the other star wheel from said shaft.

7. In an apparatus for winding webs into rolls, including a turret mounted for rotation in said frame about a substantially horizontal axis, means for incrementally driving said turret, a plurality of elongate mandrels supported for rotation on said turret and movable in an orbital path as said turret is driven, each said mandrel having a free end portion, support means on said frame operative to engage the free ends of said mandrels in operational stations thereof and for disengagement from said mandrels at core loading and wound-roll unloading stations, said mandrels exhibiting a tendency to sag at their free ends and create misalignment with said support means, the improvement comprising:

a rotatably mounted shaft having its axis substantially parallel to said mandrels in said loading and unloading stations;

a pair of star wheels rotatable with said shaft, and spaced from one another along a rotational axis thereof; and each said wheel including a plurality of generally radially outwardly presented pockets of a shape and dimension effective to engage and receive a corresponding mandrel portion as it moves in said orbital path between said loading and said operational stations, prior to its engagement by said support means, engagement of one of said star wheels by the turret-supported end of a mandrel being operative to rotate said one star wheel and said shaft, and thereby to rotate the other of said star wheels to engage said sagging free end of said mandrel and cause it to be guided into position for engagement by said support means, continued rotation of said turret disengaging said mandrel and presenting a successive pocket of each said star wheel for engagement by the successive one of said mandrels.

8. Apparatus of claim 7, wherein said mandrels are generally cylindrical, and each said pocket includes a generally circular segment corresponding substantially to the curvature of the cylindrical mandrel, said circular segment of said one of said star wheels being presented opposite to the direction of travel of said mandrel upon receiving the latter, and said circular segment in the star wheel disposed in correspondence with said free end of said mandrel being presented in a direction opposite to the direction of rotation of said star wheels.

9. Apparatus of claim 7 or 8 wherein said free ends of said mandrels are generally cone-shaped and said support means comprise means defining cone-shaped pockets for receiving said free ends.

10. Apparatus of claim 7 or 8 wherein said pockets of said star wheel disposed to engage said free end of said mandrel are of greater radial distance from said shaft then the distance of said pockets of the other star wheel from said shaft.

11. Apparatus of claim 9, wherein said pockets of said star wheel disposed to engage said free end of said mandrel are of greater radial distance from said shaft than the distance of said pockets of the other star wheel from said shaft.

* * * * *